US006843368B1

(12) United States Patent
Frutin

(10) Patent No.: US 6,843,368 B1
(45) **Date of Patent: *Jan. 18, 2005**

(54) DEVICE FOR INTRODUCING A PREDETERMINED DOSE OF ADDITIVE INTO A PACKAGED LIQUID

(75) Inventor: Bernard Derek Frutin, Renfrewshire (GB)

(73) Assignee: Rocep Lusol Holdings Limited, Renfrew (GB)

( * ) Notice: Subject to any disclaimer, the term of this patent is extended or adjusted under 35 U.S.C. 154(b) by 216 days.

This patent is subject to a terminal disclaimer.

(21) Appl. No.: 10/018,543

(22) PCT Filed: Jun. 22, 2000

(86) PCT No.: PCT/GB00/02285

§ 371 (c)(1),
(2), (4) Date: May 10, 2002

(87) PCT Pub. No.: WO00/78632

PCT Pub. Date: Dec. 28, 2000

(30) Foreign Application Priority Data

Jun. 22, 1999 (GB) ..... 9914414
Jul. 3, 1999 (GB) ..... 9915487

(51) Int. Cl.[7] ..... B65D 25/08; B65B 3/04

(52) U.S. Cl. ..... 206/219; 206/568; 206/222; 141/9; 141/67; 220/501

(58) Field of Search ..... 206/219, 222, 206/568; 215/6, 10, DIG. 8; 426/115, 112, 120; 141/9, 5, 67

(56) References Cited

U.S. PATENT DOCUMENTS 4,116,354 A * 9/1978 Kenkare et al. ..... 206/221
4,410,085 A * 10/1983 Beneziat et al. ..... 206/217
4,592,493 A 6/1986 Smith ..... 222/212
4,741,437 A * 5/1988 Gorski et al. ..... 206/222
4,917,267 A 4/1990 Laverdure ..... 222/107
5,196,216 A * 3/1993 Lynch et al. ..... 426/112
5,683,732 A * 11/1997 Baxter et al. ..... 426/115
5,725,896 A 3/1998 Banks ..... 426/112
5,863,577 A * 1/1999 Lynch et al. ..... 426/112
6,390,292 B2 * 5/2002 Hawthorne ..... 206/219
6,561,232 B1 * 5/2003 Frutin ..... 141/9

FOREIGN PATENT DOCUMENTS

EP 0 835 840 A1 4/1998 ..... B67B/3/00
WO WO 97/21605 6/1997 ..... B65D/51/28
WO WO 98/56678 12/1998 ..... B65D/71/00

OTHER PUBLICATIONS

International Search Report dated Oct. 20, 2000, for application serial number PCT/GB00/02285.

* cited by examiner

*Primary Examiner*—Jila M. Mohandesi
(74) *Attorney, Agent, or Firm*—Drinker Biddle & Reach LLP

(57) ABSTRACT

The invention relates to an apparatus for introducing an additive material (131) in the form of a liquid or granulated solid into a liquid (40) stored in a first container (150). The additive component (131) is stored separately from the liquid (40) in a dip tube or conduit (130). The dip tube (130) is a resilient hollow tubular member and has a valve (300) at one end, adapted to open when the dip tube (130) is subject to internal pressure to allow the passage of said additive material (131) therethrough. The valve prevents the additive material (131) from leaking or dripping into the liquid (40) in the first container (150) when the dip tube and first container are at the same pressure, but which allows the passage of liquid or pourable solid additive from the dip tube (130) into the liquid (40) in the first container (150) when the dip tube is pressurised by introduction of propellant fluid (116, 516). A second valve (520) can be used to prevent the additive material (131) from leaking or dripping into a second container (150) which is the source of the pressurised propellant fluid (116, 516).

12 Claims, 3 Drawing Sheets

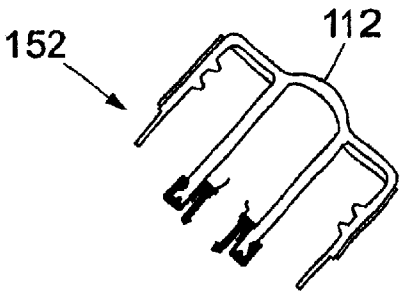
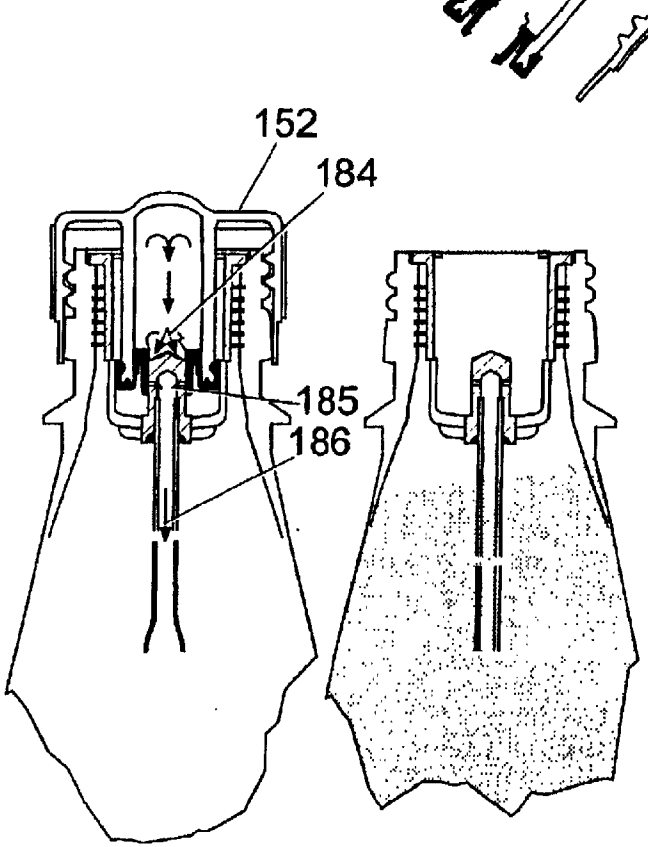
Fig. 1e
Fig. 1d
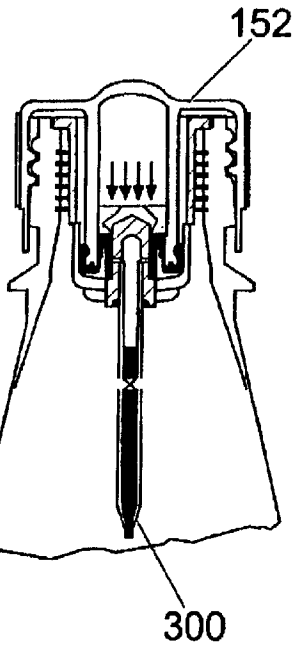
Fig. 1c
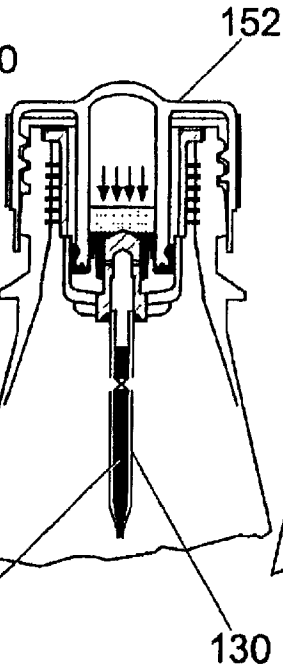
Fig. 1b
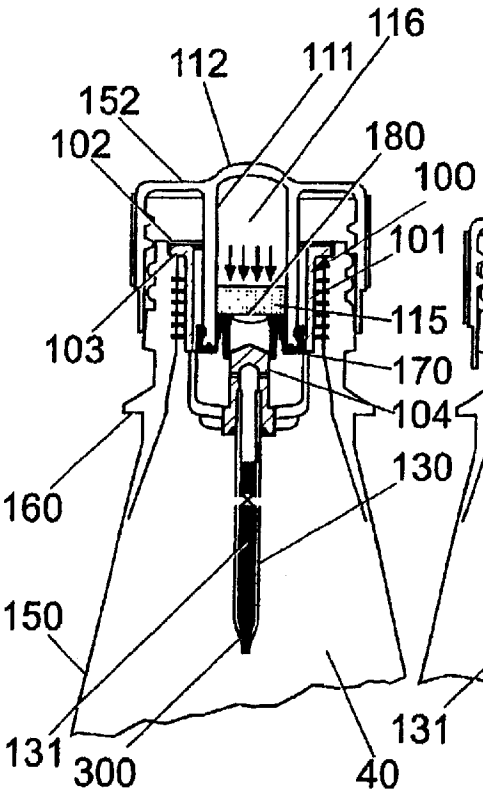
Fig. 1a

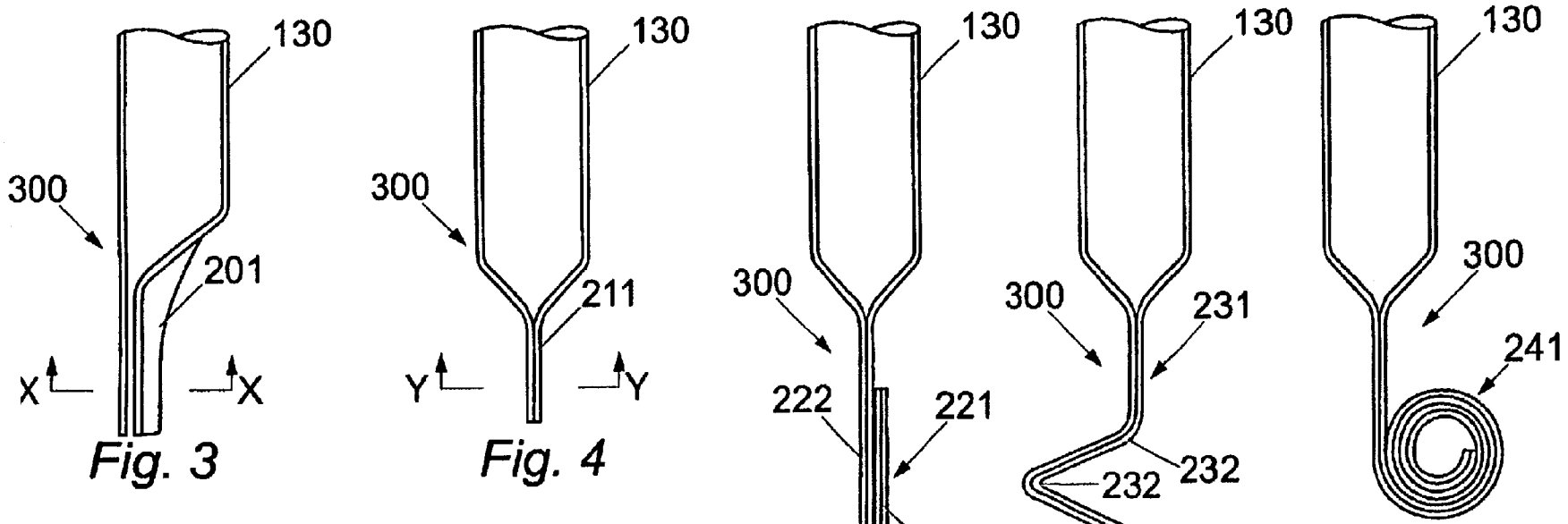
Fig. 3
Fig. 4
Fig. 5
Fig. 6
Fig. 7
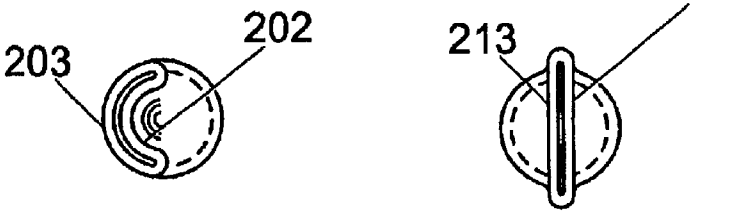
Fig. 3a
Fig. 4a

DEVICE FOR INTRODUCING A PREDETERMINED DOSE OF ADDITIVE INTO A PACKAGED LIQUID

The invention relates to an apparatus for use with a container which automatically adds an additive in the form of a liquid or a pourable solid to a liquid in the container on opening of the container. In particular the invention relates to a dip tube apparatus located within the container, the dip tube containing the additive and being closed at one end by a valve and connected at the other end to a pressure source which automatically pushes the additive through the valve into the liquid in the container on opening of the container.

In a wide number of applications, such as pharmaceuticals for both human and animal use, agrochemicals and other more general applications it may be necessary to release and mix a liquid catalyst or reagent into a liquid before the liquid may be used. In other applications, such as in the beverage industry, it may be desirable to add a component to a beverage immediately before consumption of the beverage, for example to effect a colour change, or to create a mixed beverage which has a limited storage life in the mixed state.

British Patent Application No 9823578 discloses an apparatus for introducing a component into a first liquid, the apparatus comprising a first container, such as a bottle, which holds the first liquid. The container has an opening closed by a releasable closure. A second container or tank containing pressurised propellant fluid is positioned in the neck of the first container, adjacent to the opening. A dip tube or conduit is attached to the tank, and has a first end communicating with the tank and a second end extending down into the first liquid in the first container. The dip tube contains an additive which is expelled from the dip tube into the first liquid by the entry of the propellant fluid from the tank into the conduit on release of the releasable closure.

The preferred form of dip tube is a polypropylene tube of circular cross-section, typically having an internal diameter of 5.8 mm. Such a tube has an internal capacity of 0.26 ml for each 10 mm length, so an 80 mm long tube can hold approximately 2 ml of product. The tank typically has a capacity of 2 ml, and contains pressurised propellant gas.

When the tank is of an impermeable material such as metal, then the headspace required for the propellant gas is only a proportion of the total tank volume, leaving the remainder of the tank volume as well as the tube volume available for product.

However when the tank is of a material such as plastic which exhibits long term permeability, then the headspace required for the propellant gas must be maximised, and none of the tank volume is available for product. The product must all be held in the tube. If a large volume of product is required it may be necessary to use larger diameter dip tubes capable of holding more product, and there is then a need for a valve arrangement at the lower end of the dip tube so that product does not drip or seep into the first liquid in the first container. The use of small diameter dip tubes such as capillary tubes avoids the need for valves, but such small diameter dip tubes can only hold a small amount of product.

Similarly if the product must be completely isolated from the first liquid in the first container there is a need for a valve arrangement at the lower end of the dip tube so that the first liquid cannot enter the dip tube by capillary action.

There is therefore a need for a dip tube apparatus which has a dip tube containing the additive and closed at one en e, whereby the valve can be readily opened when a pressure source pushes the additive through the valve out of the dip tube.

According to the present invention there is provided an apparatus for introducing an additive material into a first liquid, the apparatus comprising:

a first container for holding the first liquid having an opening closed by a releasable closure, a second container positioned in the first container and containing propellant fluid at a pressure greater than atmospheric pressure, and a tubular conduit having a first end communicating with the second container and a second end communicating with the first container;

wherein the conduit contains an additive material adapted to be expelled from the conduit into the first liquid by the entry of the propellant fluid into the conduit on release of the releasable closure;

and wherein the conduit is provided with a first valve adjacent to its second end, the first valve being adapted to prevent the passage of said additive material into said liquid when the pressure in said conduit is equal to the pressure in said liquid, and the first valve being adapted to permit the passage of said additive material into said liquid when the pressure in said conduit is greater than the pressure in said liquid.

It is to be understood that the liquid may be a gel, a cream or a gel-like material.

In one embodiment the first container may be a bottle having a neck. The second container may be a tank or similar provided on the underside of the releasable closure. The conduit may extend below the surface of the first liquid in the bottle. Alternatively the conduit may extend to a position close to the wall of the first container above the surface of the first liquid, to avoid foaming of the liquid and the creation of pressure waves in the liquid.

In another embodiment the first container may be a can. The releasable closure may be a ring pull closure or other known closure suitable for use with a can. The can may have a cylindrical wall and two end walls, the closure being provided in one of the end walls. Preferably the second container is a tank attached to the inner surface of one of the end walls. Alternatively the second container may be freely suspended in the first liquid in the can. Preferably the propellant fluid is gas. Preferably the second container is placed in the can prior to filling of the can with the first liquid under a pressure greater than atmospheric pressure.

A second valve may be provided in the conduit adjacent to the first end of the conduit, the second valve being adapted to prevent the passage of said additive material into said second container, and the second valve being adapted to permit the passage of said propellant fluid into said conduit when the pressure in said conduit is less than the pressure in said second container.

In one embodiment the conduit comprises a hollow tubular member of resilient plastics material, the first valve comprising a flattened end portion of the hollow tubular member, the flattened end portion comprising two opposing walls held in contact with each other by the resilience of the plastics material and adapted to move out of contact with each other when the hollow tubular member is subject to internal pressure to allow the passage of said additive material therethrough.

Preferably the flattened end portion is formed by applying heat to the tubular member. Preferably the heat is sufficient to cause plastic deformation of the material, but not sufficient to cause melt bonding of the opposing walls.

The two opposing walls may be substantially planar. Alternatively the two opposing walls may be arcuate in transverse section, the outer surface of a first one of the opposing walls being in contact with the inner surface of the second one of the opposing walls.

The flattened end portion may comprise one or more transverse folds. Alternatively the flattened end portion may be curved or bent about a transverse axis. The flattened end portion may be rolled about a transverse axis.

Preferably the tubular member is of plastic, most preferably of polypropylene or HDPE. Preferably the tubular member is of circular cross-section.

In one embodiment the first valve comprises a plug means adapted to be ejected from the conduit when the pressure in said conduit is greater than the pressure in said liquid.

The second valve may also comprise a plug means adapted to be propelled along the conduit when the pressure in said conduit is greater than the pressure in said liquid, thereby causing the additive material to be ejected from the conduit.

The first valve may be any suitable valve means, such as a poppet valve or similar. The second valve may be any suitable valve means, such as a one way valve.

The conduit may contain a number of additives arranged at different positions along the length of the conduit. The additives are preferably liquid. However the additives may be provided in granule or powder form, preferably soluble. The additives may be colouring agents, flavouring agents, fragrances, pharmaceutical components, chemicals, nutrients, liquids containing gases in solution etc.

Examples of apparatus in accordance with the invention will now be described with reference to the accompanying drawings, in which:—

FIGS. 1(*a*) to 1(*e*) are cross-sectional views of a first embodiment of an apparatus of the invention, in which a container containing propellant fluid is integrally formed in a bottle top, showing the top before screwing on, during screwing on, screwed on tight, during release and fully removed respectively;

FIG. 3 is a longitudinal cross-sectional view through a first embodiment of a dip tube and valve of the invention in its closed state;

Figure 8:
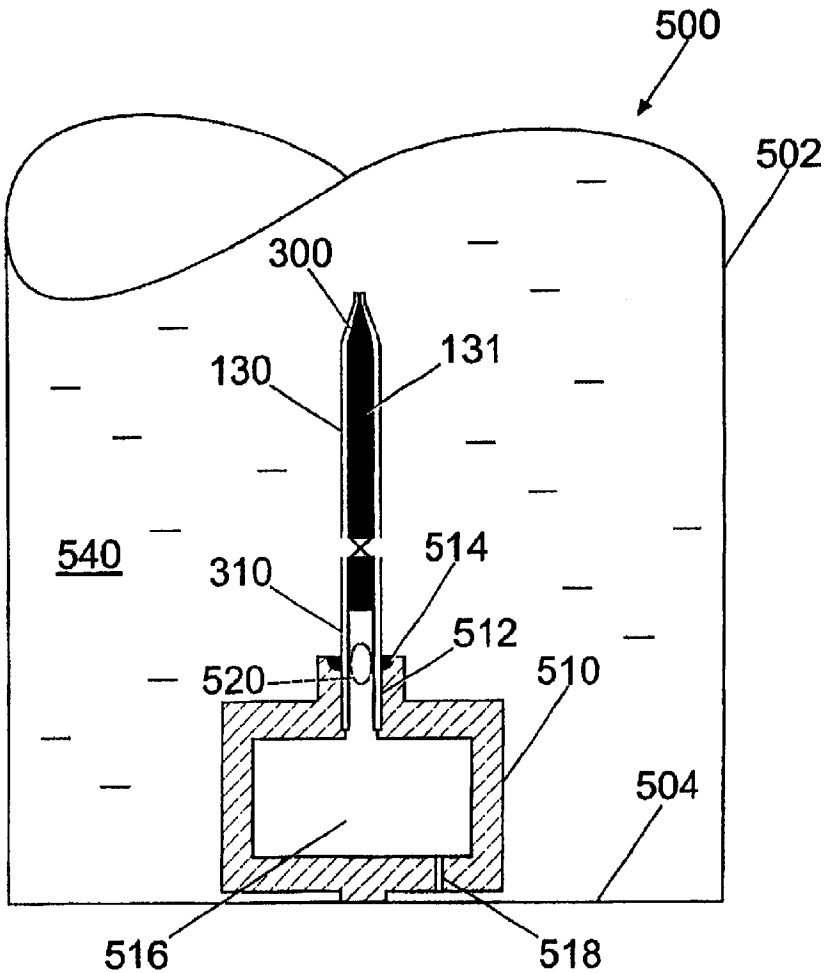

FIG. 3*a* is a section on line X—X through the valve of FIG. 3;

FIG. 4 is a longitudinal cross-sectional view through a second embodiment of a dip tube and valve of the invention in its closed state;

FIG. 4*a* is a section on line Y—Y through the valve of FIG. 4;

FIGS. 5 to 7 are longitudinal cross-sectional views through third, fourth and fifth embodiments respectively of a dip tube and valve of the invention in its closed state; and FIG. 8 is a cross-sectional view of a second embodiment of an apparatus of the invention, in which the first container holding the liquid is a can.

FIGS. 1(*a*) to 1(*e*) show an apparatus for automatically dispensing a product from a dip tube to a bottle or first container by means of pressurised propellant stored in a tank or second container when the top is removed from the bottle. The tank or second container is integrally formed with a screw top which is then screwed onto the bottle or first container, in the neck of which is secured an insert which has a rupturing spike and a dip tube.

Figure 2:
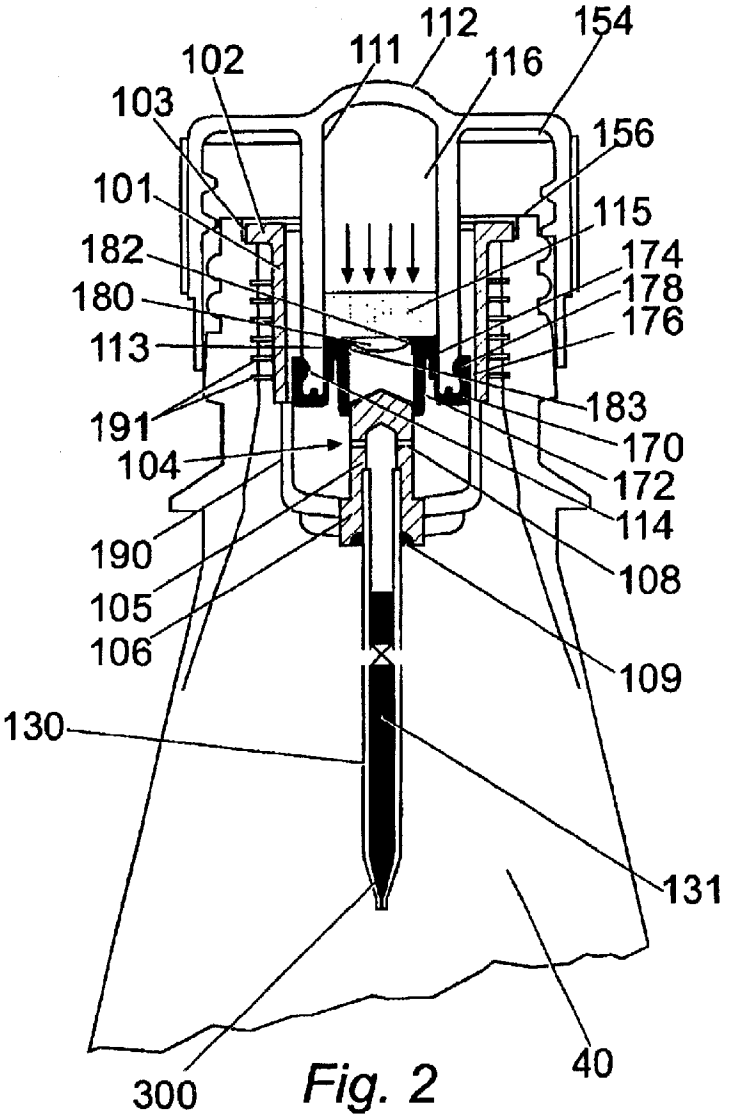
FIG. 2 is a cross-sectional view of the embodiment of FIG. 1(*a*) to an enlarged scale.

FIG. 1(*a*) shows a bottle 150 having an insert 100 secured within the neck 160 of the bottle, shown in more detail in FIG. 2. The screw cap 152 is shown separately, before closure of the bottle 150. The cap 152 has an internal thread to mate with the external thread on the neck 160 of the bottle. The cap has an integrally moulded cylindrical portion which forms an inner container 111, which is closed at the upper end by a convex portion 112 of the cap 152, so as to resist internal pressure in the inner container, and is open at the lower end 113. A circumferential groove 114 is provided externally at the lower end 113 of the inner container 111.

A plastic ferrule 170 comprises an inner cylindrical wall 172 forming a chamber which is open at its lower end and closed by a foil seal or membrane 180 at its upper end. The inner cylindrical wall 172 is connected and sealed at its upper end to an outer cylindrical wall 174, whose outside diameter is selected to fit tightly within the inside diameter of the inner container 111. At the lower end of the outer cylindrical wall 174 is provided a return flange 176 which has a circumferential rib 178 adapted to cooperate with the groove 114 on the outside wall of the inner container 11. The inner wall 172 has upper and lower sealing ribs 182, 183 which are adapted to provide a pressure resistant seal against the outer surface of the rupturing member 104.

The ferrule 170 is secured by a snap fit to the lower end 113 of the inner container 111, to provide a pressure resistant closure to the container. The inner container is filled with liquid 115 and pressurised gas 116 in a conventional fashion, so that the inner container is under internal pressure, causing the foil seal 180 to bow outwards.

An insert 100 is secured by any suitable means within the neck 160 of the bottle 150. The insert 100 comprises a substantially cylindrical housing 101 open at the upper end and having a number of legs 190 projecting from the lower end. The housing is provided with detent members 191 which engage with the inside of the neck 160 of the bottle, so that the insert 100 cannot be readily removed. The upper end of the housing has a lip 102 which is adapted to engage with a recess 103 in the neck 160 of the bottle, to prevent the insert from being pushed down inside the neck.

The legs 190 are connected at their lower end to a hollow spike member 104, which has a small diameter bore portion 105 at its upper end and a large diameter bore portion 106 at its lower end. Between the legs are apertures which allow the passage of liquid between the spike member 104 and the side of the bottle when the liquid is poured from the bottle. The number of legs and intervening apertures may be two, three, four or more as appropriate.

Within the wall of the small diameter bore portion 105 are provided a number of radial passages 108 which communicate with the hollow interior of the spike 104 and the interior of the housing 101. Extending from the bottom of the hollow rupturing member 104 is a dip tube or conduit 130, surrounded by a plastic or sprung steel cone washer 109 which is secured to the rupturing member 104 and serves as a one-way retaining member to allow the conduit 130 to be inserted up into the large diameter bore 106 but to restrain it from being removed in a downwards direction. The large diameter bore portion 106 has an internal diameter equal to the external diameter of the dip tube 130. The step between the large and small diameter bore portions 105, 106 prevents the dip tube 30 extending into the small diameter bore portion 10S and blocking the radial apertures 108.

In use, the inner container 111 is filled with a liquid 115 and a pressurised gas 116 by means of conventional technology used to fill pressurised dispenser packs, commonly known as aerosol containers. Alternatively the inner container 111 may be filled solely with pressurised gas 116, omitting the liquid 115.

FIG. 1(*b*) shows the cap 152 while it is being screwed on to the neck 160. On application of the closure or cap 152 to the bottle 150, the inner container 111 is moved downwards and the spike 104 enters the space formed by the inner cylindrical wall 172 of the ferrule 170.

When the closure 152 is fully screwed tight on to the bottle 150, the inner container ill moves to the position shown in FIG. 1(*c*), in which the seal member 154 inside the cap 152 seals tightly against the top 156 of the bottle neck 160. When this happens, the spike 104 bursts the rupturable membrane 180 and the member hollow spike extends into the inner container 111. In this position the liquid 115 and gas 116 are prevented from escaping from the inner container 111 by the ferrule 170 and spike member 104 which seal against each other to prevent release of the liquid 115 and gas 116 from the container 111. The upper sealing rib 182 and lower sealing rib 183 formed inside the inner cylindrical wall 172 of the ferrule 170 both seal against the outer surface of the spike member 104.

The inner container 111 remains in the position shown in FIG. 1(*c*) until a user releases the closure 152 from the bottle 150. When this occurs, the inner container 111 moves to the position shown in FIG. 1(*d*). In this position the upper sealing rib 182 becomes unsealed from the spike member 104, but the lower sealing rib 183 remains in sealing contact with the outer surface of the spike member, below the apertures 108. This leaves an escape passage for the compressed liquid 115 (or gas 116), which is forced out of the container 111 by the pressurised gas 116 in the direction of arrows 184, 185, 186, between the spike member 104 and ferrule 170, through the radial passages 108 and into the dip tube 130. The liquid 115 or gas 116 then passes through the dip tube 130, expelling the concentrate or additive material 131 from the dip tube 130 through the valve 300, shown schematically in FIGS. 1 and 2, into the liquid or other substance contained in the bottle 150. On removal of the closure 152, the inner container 111 and ruptured ferrule 170 are removed from the bottle 150 together, as shown in FIG. 1(*e*), leaving the insert 100 and dip tube 130 in the bottle. The insert does not impede pouring of the liquid in the bottle, which can flow between the support legs 190 of the insert 100.

The dip tubes 130, typically thin-walled polypropylene tubes such as used in the manufacture of drinking straws or similar, may be of different diameter or length and may contain different predetermined doses of additives. However the dip tubes may be larger diameter plastic tubes, holding for example 10 ml of additive material The tank 111 may be only 2.5 ml in volume, if pressurised to four or five times atmospheric pressure, so that on release of the closure 152 the propellant 116 expands to four or five times its volume, therefore expelling all the additive product 131 from the dip tube 130.

FIGS. 3 to 7 show five different embodiments of the valve 300 provided at the lower end of the dip tube 130. In all cases the material 131 is held in the dip tube by the flattened end portion of the dip tube, and cannot exit from the dip tube until the dip tube is pressurised, causing the flattened end portion to open. The flattened end portion is formed by applying heat to the end of the dip tube 130. The heat is sufficient to cause plastic deformation of the material, but not sufficient to cause melt bonding of the opposing walls.

In the first embodiment of FIG. 3 the lower end of the dip tube 130 is provided with a flattened, duck bill shaped end portion 201. This arrangement requires a significant internal pressure before the valve will open, since the natural spring action of the inner wall 202 means it must "pop" open away from outer wall 203.

In the second embodiment of FIG. 4 the lower end of the dip tube 130 is provided with a simple, planar, flattened end portion 211. The heating action means that the two walls 212, 213 are in equilibrium in the closed position.

In the third embodiment of FIG. 5 the flattened end portion 221 is folded back on itself, to provide a more secure closure. A high internal presuure is required, first to expand the upper portion 222 of the flattened end portion 221, and then to cause the fold 223 to straighten out, before the lower portion 224 can expand. The heating action means that the fold 223 is in equilibrium in the folded position.

The fourth embodiment of FIG. 6 is similar to that shown in FIG. 5, except that there are three folds 232 provided in the flattened end portion 231. Two or four or more folds may be provided if required.

In the fifth embodiment of FIG. 7 the flattened end portion 241 is rolled in a coil, which unrolls upon the application of internal pressure to the dip tube 130.

FIG. 8 shows a partial view of a beverage can 500 having a cylindrical side wall 502, a lower end wall 504 and an upper end wall (not shown) which is provided with a conventional ring pull closure (not shown). Inside the can 500 a substantially impervious propellant container 510, which may be of metal or plastic, is secured to the inner surface of the end wall 504. The propellant container 510 has a single large opening 512 at its upper side, as well as a very small diameter bleed hole 518 at its lower side, typically 0.3 mm in diameter or less. Extending from the opening 512 is a dip tube or conduit 130, surrounded by a plastic or sprung steel cone washer 514 which is secured to the rupturing member container 510 and serves as a one-way retaining member to allow the conduit 130 to be inserted into the opening 512 but to restrain it from being removed therefrom. Other methods of securing the dip tube 130 to the propellant container 510 may be used, in place of washer 514.

After the can 500 is filled with the beverage 540, liquid nitrogen is added to the beverage 540, the can 500 is sealed and inverted. The headspace in the can reaches an equilibrium pressure $P_f$ significantly higher than atmospheric pressure. This is a known technique with "widget" technology. Before filling the can with beverage, the unpressurised propellant container 510 and the dip tube, which contains additive product 131, are both attached to the bottom surface 504 of the can. The nitrogen gas in the headspace slowly enters the propellant container 510 through the bleed hole 518 over a time of several minutes, until the interior of the propellant container reaches the higher pressure, so that the insides of the can and the container 510 remain at the higher equilibrium pressure $P_f$. The can may then be placed the correct way up again. When the can is opened by releasing the ring pull closure, the pressure of the beverage in the can reverts to atmospheric pressure $P_a$. As a result of the pressure difference between the interior of the propellant container 510 and the interior of the can 500, propellant 516, in this case nitrogen gas, at pressure $P_f$ is forced through the opening 512 and along the dip tube 130, forcing open the valve 300 and expelling the concentrate or additive material 131 from the dip tube 130 through the valve 300, shown schematically in FIG. 8, into the beverage 540 or other substance contained in the can 500. The path through the dip tube 130 represents a path of less resistance for the propellant 516 than through the bleed hole 518, because of the small size of the bleed hole 518.

To prevent additive 131 from passing into the propellant container 510, a second valve (not shown) may be provided in the portion 310 of the dip tube 130 adjacent to the opening 512. This second valve may be any form of one way valve. Alternatively a readily rupturable membrane (not shown) may be provided at the opening 512 of the propellant container, which ruptures as soon as there is a greater pressure in the container 510 than outside. Alternatively a plug 520, shown in dotted outline in FIG. 8, such as a ball of glycerine or some inert gel-like substance, may be inserted in the portion 310 of the dip tube 130 to prevent additive 131 from passing into the propellant container 510. The plug 520 is driven up through the dip tube under pressure from the propellant 516 on opening of the can 500.

It is envisaged that the dip tube valve arrangement may find other applications, and the invention is not be limited to use of the valve with the pressurised dispensing devices as shown in FIGS. 1(*a*) to 1(*e*) and FIG. 8.

The invention can be used with fragrances, flavouring, pharmaceuticals (particularly suitable because of the accurate dosage obtainable), chemicals, vitamins etc. The tubes can be filled precisely at a different location and then inserted into the housing at the point of filling the bottles. Compressed air or other gas is particularly suitable as a propellant for powdered or granulated solids, so that liquid does not cause the solids to adhere to the side of the dip tube.

The dip tube valve of the invention is an inexpensive valve arrangement which prevents the product in a dip tube from leaking or dripping into the first liquid in the first container when the dip tube and first container are at the same pressure, but which allows the passage of liquid or pourable solid product from the dip tube into the first liquid in the first container when the dip tube is pressurised by introduction of the propellant fluid.

Modifications and improvements may be incorporated without departing from the scope of the invention.

What is claimed is:

1. An apparatus for introducing an additive material into a first liquid, the apparatus comprising:

a first container for holding the first liquid having an opening closed by a releasable closure, a second container positioned in the first container and containing propellant fluid at a pressure greater than atmospheric pressure, and a tubular conduit having a first end communicating with the second container and a second end communicating with the first container;

wherein the conduit contains an additive material adapted to be expelled from the conduit into the first liquid by the entry of the propellant fluid into the conduit on release of the releasable closure;

wherein the conduit is provided with a first valve adjacent to its second end, the first valve being adapted to prevent the passage of said additive material into said first liquid when the pressure in said conduit is equal to the pressure in said first liquid, and the first valve being adapted to permit the passage of said additive material into said first liquid when the pressure in said conduit is greater than the pressure in said first liquid; and wherein the second container has a bleed hole in communication with the first container adapted to permit the pressure in the second container and the first container to reach equilibrium over a period of time.

2. An apparatus according to claim 1, wherein the liquid is a gel or gel-like material.

3. An apparatus according to claim 1, wherein the first container is a can and the releasable closure is a ring pull closure.

4. An apparatus according to claim 3, wherein the can has a cylindrical wall and two end walls, the second container being attached to the inner surface of one of the end walls.

5. An apparatus according to claim 1, wherein the conduit comprises a hollow tubular member of resilient plastics material, the first valve comprising a flattened end portion of the hollow tubular member, the flattened end portion comprising two opposing walls held in contact with each other by the resilience of the plastics material and adapted to move out of contact with each other when the hollow tubular member is subject to internal pressure to allow the passage of said additive material therethrough.

6. An apparatus according to claim 5, wherein the flattened end portion is formed by applying heat to the tubular member.

7. An apparatus according to claim 5, wherein the two opposing walls are substantially planar.

8. An apparatus according to claim 5, wherein the two opposing walls are arcuate in transverse section, the outer surface of a first one of the opposing walls being in contact with the inner surface of the second one of the opposing walls.

9. An apparatus according to claim 5, wherein the flattened end portion comprises one or more transverse folds.

10. An apparatus according to claim 5, wherein the flattened end portion is curved, bent or rolled about a transverse axis.

11. An apparatus according to claim 1 wherein the first valve comprises a plug means adapted to be ejected from the conduit when the pressure in said conduit is greater than the pressure in said first liquid.

12. An apparatus according to claim 1 wherein the first valve comprises a poppet valve.

* * * * *